US010168653B2

(12) United States Patent
Matsuda et al.

(10) Patent No.: US 10,168,653 B2
(45) Date of Patent: Jan. 1, 2019

(54) FIXING DEVICE AND IMAGE FORMING APPARATUS INCORPORATING SAME

(71) Applicants: Ryohei Matsuda, Kanagawa (JP); Ippei Fujimoto, Kanagawa (JP); Takayuki Seki, Kanagawa (JP)

(72) Inventors: Ryohei Matsuda, Kanagawa (JP); Ippei Fujimoto, Kanagawa (JP); Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/933,588

(22) Filed: Mar. 23, 2018

(65) Prior Publication Data

US 2018/0284663 A1 Oct. 4, 2018

(30) Foreign Application Priority Data

Apr. 4, 2017 (JP) ..... 2017-074336

(51) Int. Cl.
*G03G 15/20* (2006.01)

(52) U.S. Cl.
CPC ..... *G03G 15/2053* (2013.01); *G03G 15/2007* (2013.01); *G03G 15/2042* (2013.01); *G03G 15/2064* (2013.01); *G03G 2215/2035* (2013.01)

(58) Field of Classification Search
CPC ..... G03G 15/2007; G03G 15/2042; G03G 15/2053; G03G 15/2064; G03G 2215/2035
See application file for complete search history.

(56) References Cited

U.S. PATENT DOCUMENTS

2013/0195523 A1* 8/2013 Yamaji ..... G03G 15/2053 399/329
2013/0322940 A1 12/2013 Ichiki et al.
2014/0153982 A1 6/2014 Adachi et al.
(Continued)

FOREIGN PATENT DOCUMENTS

JP 2001-154525 6/2001
JP 2008-225021 9/2008
JP 2018-010258 1/2018

OTHER PUBLICATIONS

U.S. Appl. No. 15/804,459, filed Nov. 6, 2017 Takashi Seto, et al.
(Continued)

*Primary Examiner* — Hoang Ngo
(74) *Attorney, Agent, or Firm* — Oblon, McClelland, Maier & Neustadt, L.L.P.

(57) ABSTRACT

A fixing device includes a fixing sleeve, a pair of holders, a heater, a nip formation pad, a pressing member, a pressing mechanism, and a controller. The nip formation pad has a regular crown-shaped surface abutted against an inner surface of the fixing sleeve. The pressing member forms a nip with the nip formation pad in a state of abutting against the fixing sleeve. The controller controls the pressing mechanism in a first mode in which the pressing mechanism presses the pressing member toward the nip formation pad with a first pressing force to equalize a width of the nip and a second mode in which the pressing mechanism presses the pressing member with a second pressing force greater than the first pressing force so that the width of the nip is smaller at both ends than at a center of the nip.

6 Claims, 7 Drawing Sheets

(56) References Cited

U.S. PATENT DOCUMENTS

| | | | | |
|---|---|---|---|---|
| 2016/0223961 | A1 | 8/2016 | Takagi et al. | |
| 2016/0246228 | A1 | 8/2016 | Fujimoto et al. | |
| 2016/0274510 | A1 | 9/2016 | Hase et al. | |
| 2016/0274511 | A1 | 9/2016 | Ogino et al. | |
| 2016/0274514 | A1 | 9/2016 | Ishii et al. | |
| 2016/0378027 | A1 | 12/2016 | Sawada et al. | |
| 2017/0010570 | A1 | 1/2017 | Fujimoto et al. | |
| 2017/0176907 | A1 | 6/2017 | Sawada et al. | |
| 2017/0185009 | A1 | 6/2017 | Yoshinaga et al. | |
| 2017/0185015 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0255147 | A1 | 9/2017 | Seki et al. | |
| 2017/0261900 | A1 | 9/2017 | Sawada et al. | |
| 2017/0364000 | A1 | 12/2017 | Seki et al. | |
| 2018/0011432 | A1 | 1/2018 | Yoshinaga et al. | |
| 2018/0017910 | A1 | 1/2018 | Sawada et al. | |
| 2018/0059587 | A1 | 3/2018 | Sawada et al. | |
| 2018/0157198 | A1* | 6/2018 | Seto ..... | G03G 15/2085 |

OTHER PUBLICATIONS

European Office Action dated Aug. 21, 2018 in European Application No. 18163744.8, 8 pages.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119 to Japanese Patent Application No. 2017-074336, filed on Apr. 4, 2017 in the Japanese Patent Office, the entire disclosure of which is hereby incorporated by reference herein.

BACKGROUND

Technical Field

The present disclosure relates to a fixing device to fix an image on a recording medium and an image forming apparatus incorporating the fixing device.

Background Art

Generally, a fixing device for an image forming apparatus has a fixing member having a heat source and a pressure rotator pressed against the fixing member by a pressing mechanism. When a recording sheet on which a toner image as a developer image is formed passes through a fixing nip where both the fixing member and the pressure rotator are pressed against each other, the toner image is thermally fixed on the recording sheet.

Contemporary fixing devices use a fixing sleeve as a fixing member having a low heat capacity to save energy and shorten the time to first printing.

SUMMARY

This specification describes an improved fixing device and an image forming apparatus including the fixing device.

In one illustrative embodiment, the fixing device includes a fixing sleeve, a pair of holders oppositely disposed in an axial direction of the fixing sleeve to rotatably support both ends of the fixing sleeve in the axial direction, a heater to heat the fixing sleeve, a nip formation pad, a pressing member, a pressing mechanism, and a controller. The nip formation pad is disposed between the pair of holders and has a regular crown-shaped surface abutted against an inner circumferential surface of the fixing sleeve. The pressing member is disposed opposite the fixing sleeve to form a nip with the nip formation pad in a state of abutting against the fixing sleeve, and rotates the fixing sleeve by rotation in the abutting state. The nip has a width in a direction perpendicular to the axial direction of the fixing sleeve. The pressing mechanism presses the pressing member toward the nip formation pad. The controller controls the pressing mechanism in two modes: a first mode, in which the pressing mechanism presses the pressing member toward the nip formation pad with a first pressing force to equalize the width of the nip in a longitudinal direction of the abutted surface, and a second mode, in which the pressing mechanism presses the pressing member toward the nip formation pad with a second pressing force greater than the first pressing force so that the width of the nip is smaller at both ends of the nip in the longitudinal direction than at a center of the nip in the longitudinal direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
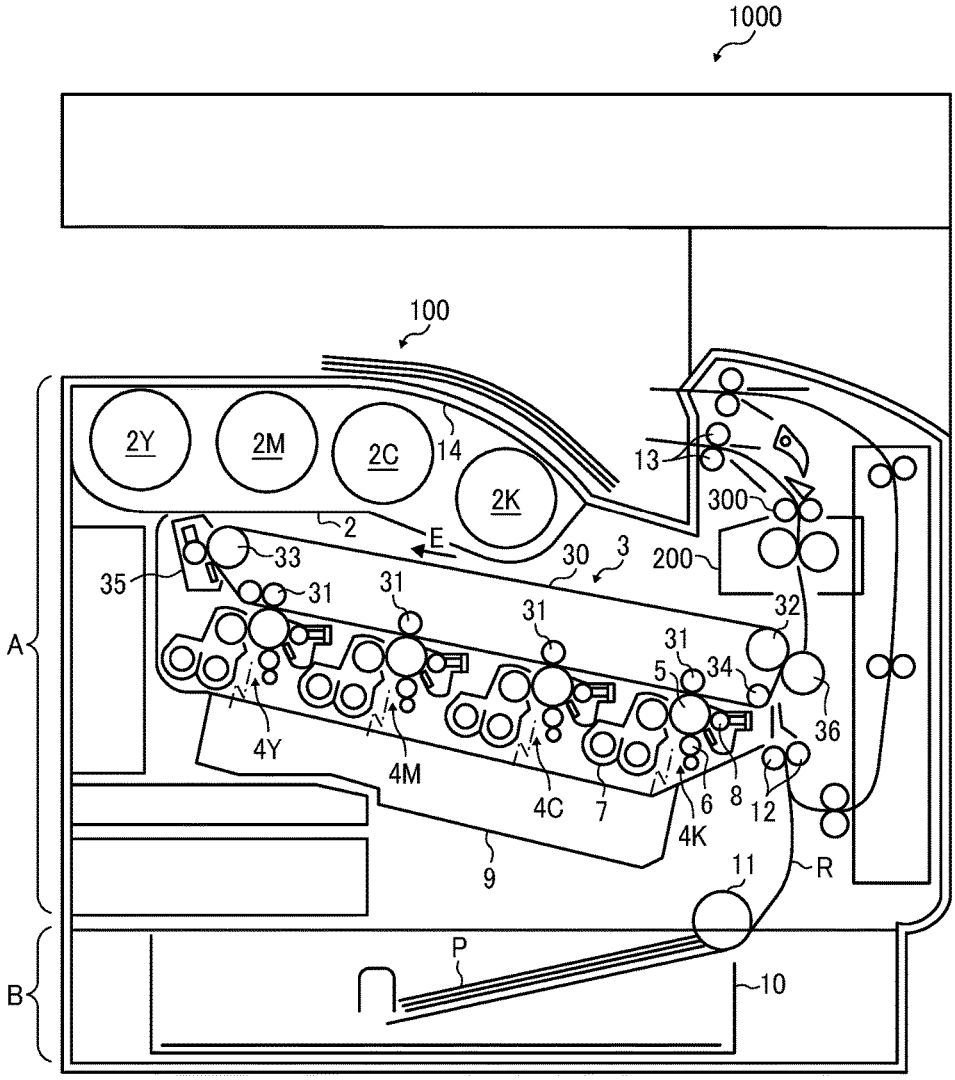
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

Below, a fixing device and an image forming apparatus according to an embodiment of the present disclosure is described below.

Image Forming Apparatus

A description is provided of the construction of an image forming apparatus 1000 according to an embodiment of the present disclosure.

As illustrated in FIG. 1, in the present embodiment, the image forming apparatus 1000 is a color laser printer, and includes an image forming section A, a sheet feed section B, a fixing device 200, a curl correction device 300, a pair of sheet ejection rollers 13, and an output tray 14. The image forming section A includes four image forming units 4Y, 4M, 4C, and 4K, an exposure device 9, and a transfer device 3. Descriptions are given in further detail below.

The image forming apparatus 1000 includes four image forming units 4Y, 4M, 4C, and 4K disposed in the center of the image forming apparatus 1000. Although the image forming units 4Y, 4M, 4C, and 4K contain developers (e.g., yellow, magenta, cyan, and black toners) in different colors, that is, yellow, magenta, cyan, and black corresponding to color separation components of a color image, respectively, the image forming units 4Y, 4M, 4C, and 4K have an identical structure.

Specifically, each of the image forming units 4Y, 4M, 4C, and 4K includes a drum-shaped photoconductor 5 as a latent image bearer; a charger 6 to charge a surface of the photoconductor 5; a developing device 7 to supply toner on the surface of the photoconductor 5; and a cleaning device 8 to clean the surface of the photoconductor 5.

In FIG. 1, each of the photoconductor 5, the charger 6, the developing device 7, and the cleaning device 8 included in the black image forming unit 4K is supplied with a reference numeral and reference numerals for other image forming units 4Y, 4M, and 4C configured similarly to the image forming unit 4K are omitted.

An exposure device 9 is disposed below the image forming units 4Y, 4M, 4C, and 4K and exposes the outer circumferential surfaces of the respective photoconductors 5 with laser beams. The exposure device 9 includes a laser light source, a polygon mirror, an f-θ lens, and a plurality of reflection mirrors to irradiate the surface of each photoconductor 5 with a laser beam based on image data and form an electrostatic latent image on the surface of each photoconductor 5.

A transfer device 3 is disposed above the image forming units 4Y, 4M, 4C, and 4K. The transfer device 3 includes an intermediate transfer belt 30 as an intermediate transfer member, four primary transfer rollers 31 as primary transfer members, a secondary transfer backup roller 32, a secondary transfer roller 36 as a secondary transfer member, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1, that is, in a rotation direction indicated by arrow E in FIG. 1.

The four primary transfer rollers 31 sandwich the intermediate transfer belt 30 together with the four photoconductors 5, forming four primary transfer nips between the intermediate transfer belt 30 and the photoconductors 5, respectively. In addition, each primary transfer roller 31 is connected to a power source and a predetermined direct current (DC) voltage or alternating current (AC) voltage is applied to each primary transfer roller 31.

The secondary transfer roller 36 sandwiches the intermediate transfer belt 30 together with the secondary transfer backup roller 32, forming a secondary transfer nip between the secondary transfer roller 36 and the intermediate transfer belt 30. In addition, similarly to the primary transfer rollers 31, the secondary transfer roller 36 is connected to a power source, and a predetermined direct current (DC) voltage or alternating current (AC) voltage is applied to the secondary transfer roller 36.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 disposed in an upper portion of the image forming apparatus 1000 accommodates four toner bottles 2Y, 2M, 2C, and 2K detachably attached to the bottle holder 2. The toner bottles 2Y, 2M, 2C, and 2K contain fresh yellow, magenta, cyan, and black toners to be supplied to the developing devices 7 of the image forming units 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

The sheet feed section B is disposed in the bottom of the image forming apparatus 1000. The sheet feed section B includes a sheet tray 10 in which a recording medium P as a sheet material is contained, and a sheet feed roller 11 to feed the recording medium P from the sheet tray 10.

The recording medium P may be thick paper, postcards, envelopes, plain paper, thin paper, coated paper, art paper, tracing paper, overhead projector (OHP) transparencies, and the like. The image forming apparatus 1000 may include a bypass feeder. According to the present embodiment, a sheet P having a basis weight of 160 grams/$m^2$ or more is defined as thick paper.

Further, a conveyance path R is disposed inside a body 100 of the image forming apparatus 1000. Through the conveyance path R, the recording medium P is conveyed from the sheet tray 10 to an outside of the body 100 via the secondary transfer nip. A registration roller pair 12 serving as a timing roller to convey the recording medium P to the secondary transfer nip at an appropriate timing for conveyance is disposed upstream from the secondary transfer roller 36 in the recording medium conveyance direction in the conveyance path R.

The fixing device 200 presses and heats the recording medium P on which an unfixed image is borne and thereby fixes the toner image onto the recording medium P. The fixing device 200 is disposed downstream from the position of the secondary transfer roller 36 in the recording medium conveyance direction. Further, a pair of sheet ejection rollers 13 to eject the recording medium P outside the body 100 of the image forming apparatus 1000 is disposed downstream from the fixing device 200 in the recording medium conveyance direction of the conveyance path R. In addition, the output tray 14 to stock the recording medium P ejected outside the image forming apparatus 1000 is disposed on an upper surface of the body 100 of the image forming apparatus 1000.

Basic Operation of Image Forming Apparatus

Next, basic operation of the image forming apparatus 1000 according to an embodiment of the present disclosure is described.

As a print job starts, a driver drives and rotates the photoconductors 5 of the image forming units 4Y, 4M, 4C, and 4K, respectively, clockwise in FIG. 1. The chargers 6 uniformly charge the outer circumferential surface of the respective photoconductors 5 at a predetermined polarity. The exposure device 9 emits laser beams onto the charged outer circumferential surfaces of the respective photoconductors 5, respectively, thus forming electrostatic latent images on the photoconductors 5.

The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner visible images, respectively.

Simultaneously, as the print job starts, the secondary transfer backup roller 32 is driven and rotated counterclockwise in FIG. 1, and rotates the intermediate transfer belt 30 in the rotation direction illustrated by arrow E in FIG. 1. The power supply applies a constant voltage or a constant current control voltage having a polarity opposite a polarity of the charged toner to the primary transfer rollers 31, creating transfer electric fields at the respective primary transfer nips formed between the photoconductors 5 and the primary transfer rollers 31.

The transfer electrical fields generated in the primary transfer nips transfer and superimpose the toner images from the respective photoconductors 5 onto the intermediate transfer belt 30 to form a full color image on the outer circumferential surface of the intermediate transfer belt 30.

After the primary transfer of the yellow, magenta, cyan, and black toner images from the photoconductors 5 onto the intermediate transfer belt 30, the cleaning device 8 removes residual toner that has failed to be transferred onto the intermediate transfer belt 30 and has remained on the photoconductors 5. Thereafter, dischargers discharge the outer circumferential surfaces of the respective photoconductors 5, returning the outer circumferential surfaces of the respective photoconductors 5 to their initial surface potential.

In the meantime, the sheet feed roller 11 disposed in the lower portion of the image forming apparatus 1000 is driven and rotated to feed the recording medium P from the sheet tray 10 toward the registration roller pair 12 through the conveyance path R. The registration roller pair 12 temporarily halts the recording medium P conveyed through the conveyance path R.

Thereafter, the registration roller pair 12 resumes rotation at a predetermined time to convey the recording medium P to the secondary transfer nip at a time when the image formed on the intermediate transfer belt 30 reaches the secondary transfer nip. The secondary transfer roller 36 is supplied with a transfer voltage having a polarity opposite a polarity of the charged yellow, magenta, cyan, and black toners constructing the image formed on the intermediate transfer belt 30, thus creating a transfer electric field at the secondary transfer nip.

The transfer electric field secondarily transfers the superimposed yellow, magenta, cyan, and black toner images constructing the image formed on the intermediate transfer belt 30 onto the recording medium P. After the secondary transfer of the full color toner image from the intermediate transfer belt 30 onto the recording medium P, the belt cleaner 35 removes residual toner that has failed to be transferred onto the recording medium P and has remained on the intermediate transfer belt 30. The removed toner is conveyed to and collected in the waste toner container.

Thereafter, the recording medium P is conveyed to the fixing device 200, and the fixing device 200 fixes the toner image on the recording medium P. The recording medium P conveyed from the fixing device 200 is ejected to the output tray 14 outside the body 100 of the image forming apparatus 1000, after passing through the curl correction device 300.

The above describes the image forming operation of the image forming apparatus 1000 to form the full color image on the recording medium P. Alternatively, the image forming apparatus 1000 may form a monochrome toner image by using any one of the four image forming units 4Y, 4M, 4C, and 4K or may form a bicolor toner image or a tricolor toner image by using two or three of the image forming units 4Y, 4M, 4C, and 4K.

Fixing Device

Next, a description is given of the fixing device 200 according to the present embodiment of the present disclosure.

Figure 2:
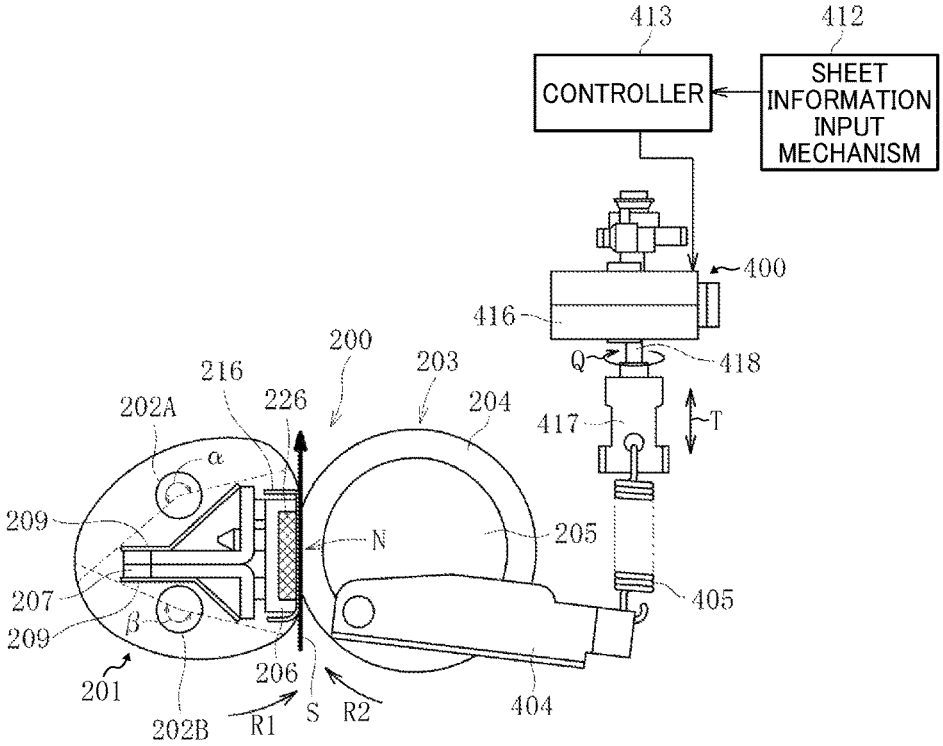
FIG. 2 is a schematic view of a fixing device according to the embodiment of the present disclosure.

As illustrated in FIG. 2, the fixing device 200 includes a fixing sleeve 201 serving as a rotatable and endless fixing member and a pressure roller 203 serving as a pressing member that is rotatable, disposed opposite the fixing sleeve 201, and contacting an outer circumferential surface of the fixing sleeve 201.

Inside the fixing sleeve 201, a first halogen heater 202A and a second halogen heater 202B (collectively referred to as halogen heaters 202) serve as a fixing heat source. The halogen heaters 202 directly heat a region other than the nip portion of the fixing sleeve 201, that is, a region illustrated by an angular range a and an angular range β in FIG. 1, with radiant heat from the inner circumferential side.

Inside the fixing sleeve 201, a nip formation pad 206 is disposed closer to the pressure roller 203 than the halogen heater 202. On the front side of the nip formation pad 206, a heat transfer member 216 is disposed as described later in FIG. 3. A nip portion N is formed between the nip formation pad 206 and the pressure roller 203.

Fixing Sleeve

The fixing sleeve 201 is an endless belt or film made of metal such as nickel and SUS stainless steel or resin such as polyimide. A pair of holders 208 oppositely disposed in the axial direction holds both ends of the fixing sleeve 201 rotatably. A surface layer of the fixing sleeve 201 has a release layer made of tetrafluoroethylene-perfluoroalkyl vinyl ether copolymer (PFA), polytetrafluoroethylene (PTFE), or the like to facilitate separation of toner and avoid toner adherence to the fixing sleeve 201.

An elastic layer made of silicone rubber or the like may be sandwiched between the base layer and the release layer such as a PFA layer or a PTFE layer. If the fixing sleeve 201 does not incorporate the elastic layer, the fixing sleeve 201 has a decreased thermal capacity that improves fixing property of being heated quickly to a desired fixing temperature at which the toner image is fixed on the recording medium. However, as the pressure roller 203 and the fixing sleeve 201 sandwich and press the unfixed toner image on the recording medium passing through the fixing nip N, slight surface asperities of the fixing sleeve 201 may be transferred onto the toner image on the recording medium, resulting in variation in gloss of the solid toner image that may appear as an orange peel image on the recording medium. To address this circumstance, the elastic layer made of silicone rubber has a thickness equal to or larger than about 100 micrometers. As the elastic layer deforms, the elastic layer absorbs slight surface asperities of the fixing sleeve 201, preventing formation of the faulty orange peel image.

Pressure Roller

In the present embodiment, the pressure roller 203 is constructed of a core bar 205, an elastic rubber layer 204 coating the core bar 205, and a surface release layer coating the elastic rubber layer 204 and made of PFA or PTFE to facilitate separation of the recording medium from the pressure roller 203. As a driving force generated by a driver (e.g., a motor) disposed inside the body 100 of the image forming apparatus 1000 that is depicted as a printer in FIG. 1 is transmitted to the pressure roller 203 through a gear train, the pressure roller 203 rotates.

A pressing mechanism 400 described later presses the pressure roller 203 against the nip formation pad 206 via the fixing sleeve 201, that is, the pressure roller 203 is in an abutting state with the fixing sleeve 201. As the pressing mechanism 400 presses and deforms the elastic rubber layer 204 of the pressure roller 203, the pressure roller 203 produces the fixing nip N having a predetermined length in the recording medium conveyance direction S.

The pressure roller 203 may be a hollow roller or a solid roller. If the pressure roller 203 is a hollow roller, a heater such as a halogen heater may be disposed inside the hollow roller. The elastic rubber layer 204 may be made of solid rubber. Alternatively, if no heater is disposed inside the pressure roller 203, the elastic rubber layer 204 may be made of sponge rubber. The sponge rubber is preferable to the solid rubber because the sponge rubber has enhanced insulation that draws less heat from the fixing sleeve 201.

Pressing Mechanism

A pressing mechanism 400 is configured to presses the pressure roller 203 against the nip formation pad 206 via the fixing sleeve 201. The pressing mechanism 400 includes a pressing arm 404 that presses a core bar 205 of the pressure roller 203 toward the nip formation pad 206 and a pressure spring 405 coupled to the pressing arm 404.

One end of the pressing arm 404 on the left side in FIG. 2 is pivotally supported by a fixed support shaft, and the lower end of the pressure spring 405 is attached to the other end of the pressing arm 404 on the right side in FIG. 2. The pressure roller 203 receives a strong urging force by the pressure spring 405 via the pressing arm 404 and presses against the fixing sleeve 201.

The pressing mechanism 400 according to the present embodiment includes a stepping motor 416 and a movable bracket 417 that changes the urging force of the pressure spring 405. The upper end of the pressure spring 405 is coupled to the lower end of the movable bracket 417.

A threaded rotary shaft 418 rotated by a stepping motor 416 is vertically threaded into the upper end portion of the movable bracket 417. Forward and reverse rotation, as an arrow Q in FIG. 2, of the threaded rotary shaft 418 by the stepping motor 416 enables the movable bracket 417 to move vertically as arrow T in FIG. 2.

The controller 413 controls rotations of the stepping motor 416. A sheet information input mechanism 412 inputs sheet information (sheet size, a number of print, a print timing, and the like) of the recording medium P in the fixing device 200 to the controller 413. The pressing mechanism 400 described above is an example, and alternatively, any well-known technique such as changing the pushing amount of the cam can be used as appropriate.

Nip Formation Pad, Heat Transfer Member, and Stay

Figure 3:
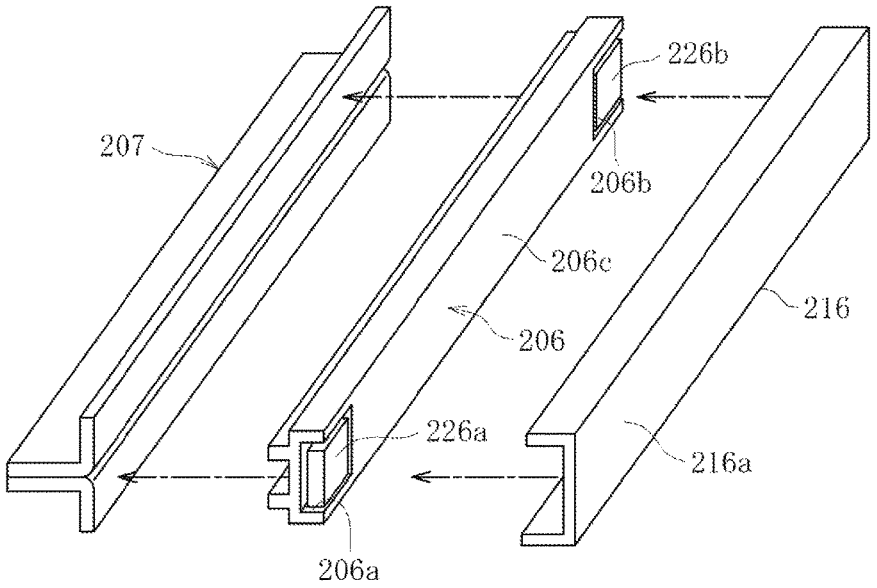
FIG. 3 is an exploded perspective view of a nip formation pad.

As illustrated in FIG. 3, the nip formation pad 206 is a rectangular parallelepiped elongated in the axial direction and formed by a heat resistant resin or the like, and the heat transfer member 216 is disposed on the front side of the rectangular parallelepiped. On the back side of the nip formation pad 206, a stay 207 having sufficient flexural rigidity to withstand the pressing force of the pressure roller 203 is disposed.

These three members have lengths extending in the width direction or the axial direction (hereinafter referred to as "longitudinal direction") of the fixing sleeve 201. Both ends of the stay 207 are supported by a pair of holders 208 that hold both ends of the fixing sleeve 201 rotatable.

Cut-out recesses 206*a* and 206*b* are formed at both end portions of the nip formation pad 206, and lateral end heaters 226*a* and 226*b* to compensate heat quantity of the halogen heaters 202 are disposed in the recesses 206*a* and 206*b*. Between the lateral end heaters 226*a* and 226*b*, a flat opposing reference surface 206*c* opposed to the pressure roller 203 is set, and the opposing reference surface 206*c* and the lateral end heaters 226*a* and 226*b* are covered with the heat transfer member 216.

The heat transfer member 216 to equalize a temperature of the nip portion N in the axial direction equalizes a temperature of the fixing sleeve 201 in contact with the opposing reference surface 206*c* in the axial direction and prevents local temperature rise caused by the heat of the lateral end heaters 226*a* and 226*b*. An opposing face 216*a* of the front face of the heat transfer member 216 becomes a nip formation face that directly contacts the inner surface of the fixing sleeve 201, but, since the heat transfer member 216 is made of a thin sheet metal, from the aspect of mechanical strength, the opposing reference surface 206*c* of the nip formation pad 206 becomes the substantial nip formation face, and a pressing face that presses the inner circumferential surface of the fixing sleeve 201.

The above described stay 207 serving as a support that supports the nip formation pad 206 to form the fixing nip N is disposed inside the loop formed by the fixing sleeve 201. As the nip formation pad 206 receives pressure from the pressure roller 203, the stay 207 supports the nip formation pad 206 to prevent bending of the nip formation pad 206 and produce an even nip width in an axial direction.

The stay 207 has a shape having a projection projected from the opposite face to the fixing nip N side. The projection separates a first halogen heater 202A and a second halogen heater 202B as fixing heat sources from each other. These two halogen heaters 202 directly heat the inner surface of the fixing sleeve 201 with radiant heat. Disposing each of halogen heaters 202 inside the fixing sleeve 201 makes it easy to make the compact fixing device 200 including the rotatable endless fixing sleeve 201.

The stay 207 is mounted on and held by flanges serving as a holder 208 at both lateral ends of the stay 207 in a longitudinal direction thereof parallel to the axial direction of the fixing sleeve 201, respectively, thus being positioned inside the fixing device 200. The reflector 209 interposed between the two halogen heaters 202 and the stay 207 prevents the stay 207 from being heated by each of the halogen heaters 202 with radiant heat and the like and thereby reducing waste of energy.

Operation of Fixing Device

As the pressure roller 203 rotates in the rotation direction R1, the fixing sleeve 201 rotates in the rotation direction R2 in accordance with rotation of the pressure roller 203 by friction therebetween. As the driver drives and rotates the pressure roller 203, the driving force of the driver is transmitted from the pressure roller 203 to the fixing sleeve 201 at the fixing nip N, thus rotating the fixing sleeve 201 by friction between the pressure roller 203 and the fixing sleeve 201 in the present embodiment of FIG. 2. At the fixing nip N, the fixing sleeve 201 is sandwiched between the pressure roller 203 and the nip formation pad 206 and rotates; at a circumferential span of the fixing sleeve 201 other than the fixing nip N, the fixing sleeve 201 is guided by a flange of a pair of holders 208 disposed opposite to each other in the axial direction thereof and rotates. The fixing device 200 is a quick start up (QSU) type fixing device configured as described above, which shortens the warm-up time.

Regular Crown Shape of the Nip Formation Pad

Figure 4:
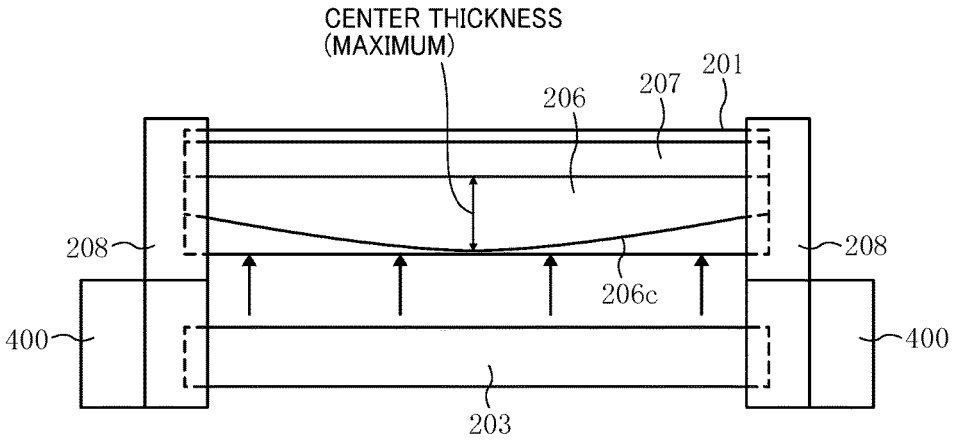
FIG. 4 is a schematic layout view of the nip forming pad, a pressure roller, and a pressing mechanism.

Specifically, as illustrated in FIG. 4, the nip formation pad 206 is formed into a regular crown shape so that the thickness at the center in the longitudinal direction is maximized.

For example, in the nip formation pad 206 according to a comparative example, the opposing reference surface 206*c* opposed to the pressure roller 203 is constituted as a flat surface in the longitudinal direction. Pressing force applied to the both ends of the pressure roller 203 from the pressing mechanism 400 deforms both end portions of the pressure roller 203 larger than a center portion of the pressure roller 203 on the opposing reference surface 206*c*. This pressing force also pushes the nip formation pad 206 and bends the center portion of the nip formation pad 206 in the longitudinal direction into a concave shape. Therefore, the increase in the pressing force of the pressure roller 203 increases the lateral end nip width, but always tends to leave the center nip width narrower as illustrated by the broken line in FIG. 5.

In the embodiment of the present disclosure, the opposing reference surface 206*c* of the nip formation pad 206 is formed into the regular crown shape as illustrated in FIG. 4. In other words, the nip formation pad 206 has a shape that becomes thicker continuously symmetrically and smoothly from both ends to the center. The thickness of the nip formation pad 206 is greatest at the center portion in the longitudinal direction thereof. The pressing mechanism 400 described above is configured to press both ends of the pressure roller 203 toward the nip formation pad 206, as indicated by the arrows in FIG. 4, and the controller 413 adjusts the magnitude of the pressing force.

Figure 5:
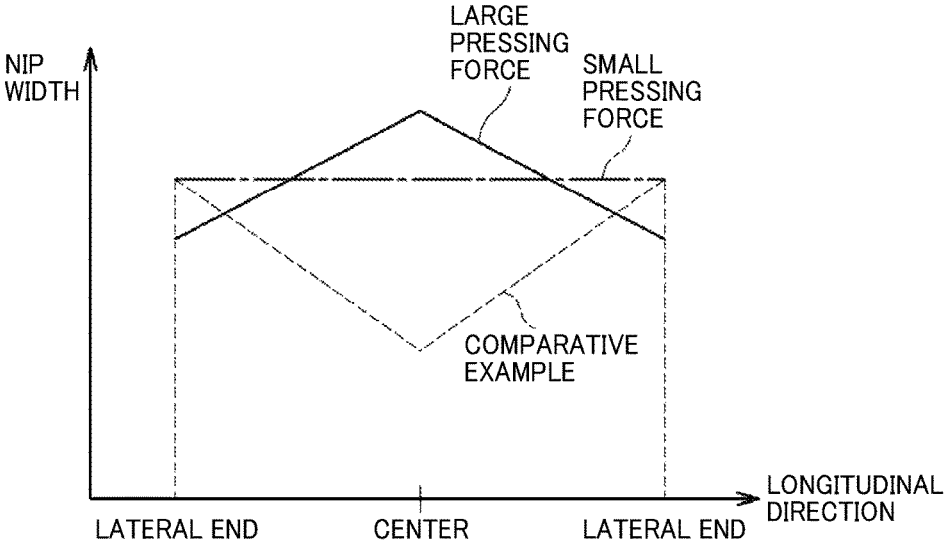
FIG. 5 is an explanatory diagram illustrating a change in a nip width in a longitudinal direction, which is caused by a change of a pressing force.

When an ordinary sheet is used, the controller 413 employs a first mode, that is, it applies small pressing force as a pressing force P1 to the pressure roller 203, and sets the nip width evenly in the longitudinal direction as illustrated in an one-dot chain line in FIG. 5. When a large-size sheet is used after small-size sheets continuously used, the controller 413 employs a second mode, that is, the controller 413 changes the pressing force larger (P1→P2) and applies a large pressing force as a second pressing force P2 to the pressure roller 203. As a result, the controller 413 sets the nip width at the center portion larger and the nip width at the end portions smaller than the nip width in the first mode as illustrated in a solid line in FIG. 5. In the second mode, heat transfer from the nip portion N to the both end portions of the large-size sheet decreases, therefore, the fixing failure (hot offset) caused by the temperature rise at lateral ends is prevented.

Here, the small-size sheet means a recording medium having a lateral width D1 narrower than the longitudinal length of the halogen heater 202 as the heat source. The large-size sheet means a recording medium having a lateral width D2 larger than the lateral width D1 of the small-size sheet.

Figure 6A:
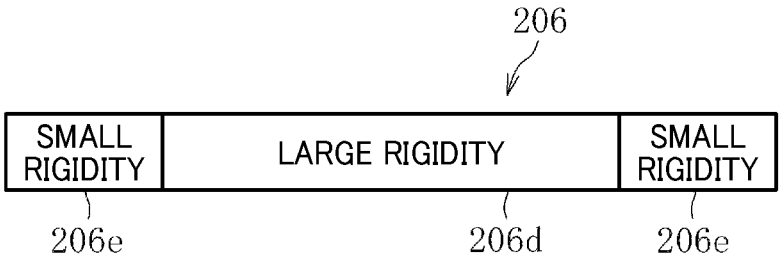
FIG. 6A is an explanatory diagram illustrating a rigidity distribution in the nip formation pad.
Figure 6B:
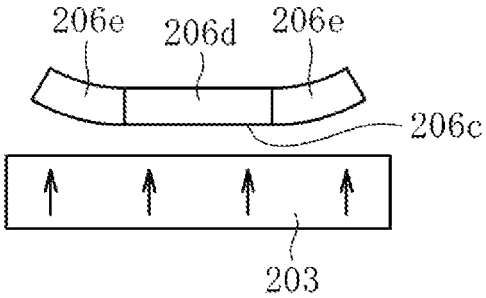
FIG. 6B is an explanatory diagram illustrating the nip formation pad deformed under pressure from a pressure roller.

FIGS. 6A and 6B illustrate a configuration in which the rigidity of the nip formation pad 206 is made different between the longitudinal center portion and both end portions. The pressing force of the pressure roller 203 may dent the center portion of the nip formation pad 206 having only the regular crown shape illustrated in FIG. 4. Therefore, as illustrated in FIGS. 6A and 6B, the center portion 206*d* of the nip formation pad 206 is made of a material having large rigidity, and both end portions 206*e* of the nip formation pad 206 are made of a material having lower rigidity than the material of the center portion 206*d*. In this configuration, as illustrated in FIG. 6B, pressure from the pressure roller 203 to the nip formation pad 206 that presses the nip formation pad 206 in a direction of arrows in FIG. 6B allows bending the end portions 206*e* but does not bend the center portion 206*d* as much, and as a result, decreases the lateral end nip width.

As a specific material of the nip formation pad 206, the both end portions 206*e* may be made of polypropylene (PP) resin having low rigidity, and the center portion 206*d* may be made of liquid crystal polymer (LCP) resin having high rigidity.

Figure 7A:
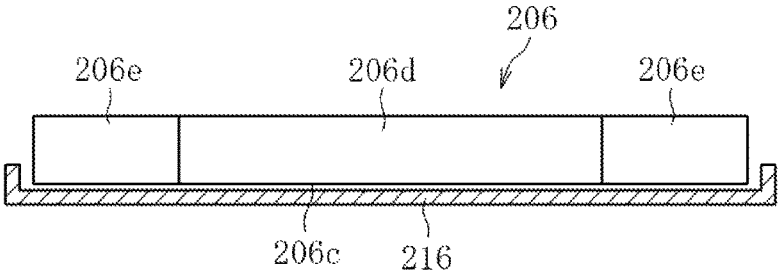
FIG. 7A is a schematic diagram illustrating the nip formation pad assembled in a heat transfer member.
Figure 7B:
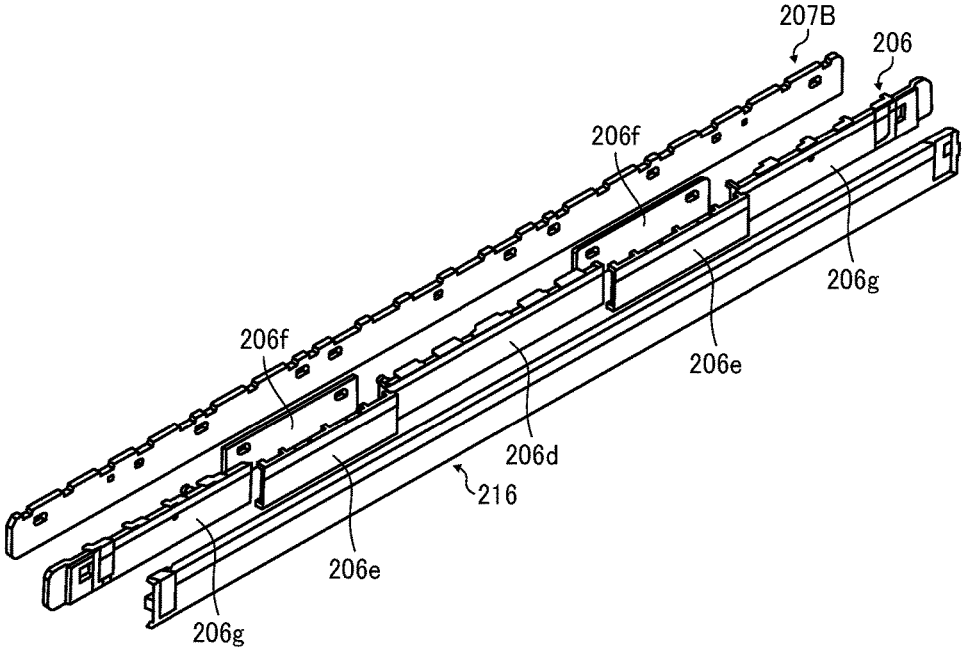
FIG. 7B is an exploded perspective view of the nip formation pad.

However, assembling different rigid members to one nip formation pad 206 is not easy. Therefore, as illustrated in FIGS. 7A and 7B, a member of the center portion 206*d* and members of the both end portions 206*e* and 206*f*, each of which has different rigidity, may be arranged in the longitudinal direction of the nip formation pad 206, and be integrally assembled to the heat transfer member 216. Such a configuration as illustrated in FIGS. 7A and 7B can reduce the lateral end nip width and waiting time for large-size sheet printing after small-size continuous sheet printing. In FIG. 7B, the nip formation pad 206 also includes both end portions 206*g*, and the stay 207 includes a connecting plate 207B.

Figure 8:
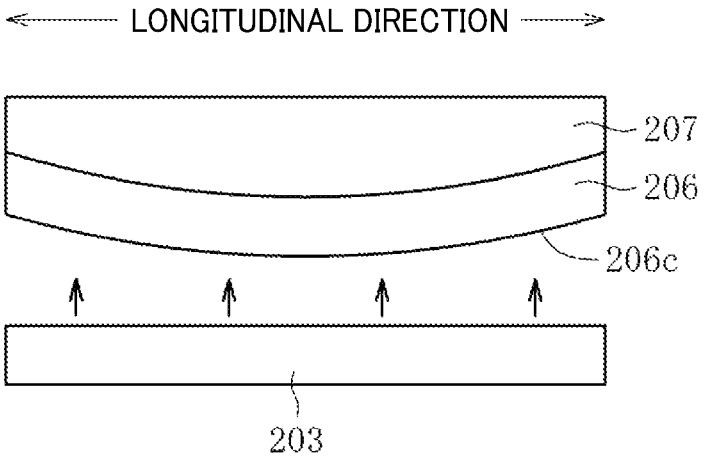
FIG. 8 is an explanatory diagram illustrating a variation of the nip formation pad.

In FIG. 8, the stay 207 that supports the nip formation pad 206 has the regular crown shape in which the center portion in the longitudinal direction protrudes toward the pressure roller 203 similarly to the nip formation pad 206. This configuration enables the stay 207 to support the center portion of the nip formation pad 206, increase rigid strength of the center portion of the nip formation pad 206, and keep distribution of the nip width as illustrated by the solid line in FIG. 5 securely.

Figure 9:
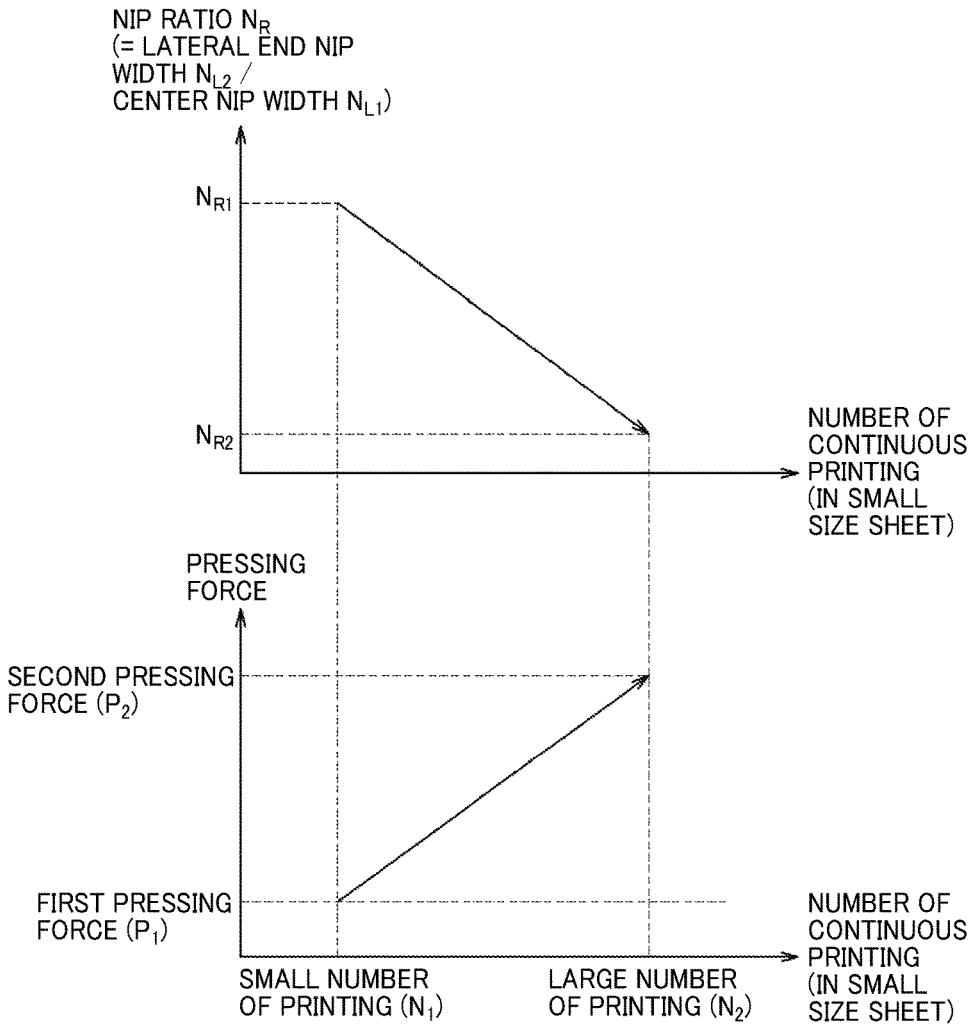
FIG. 9 is an explanatory diagram illustrating a method of increasing the pressing force when a large-size sheet is printed after continuously feeding small-size sheets.

FIG. 9 illustrates an example of pressing control in the second mode by the controller 413. In FIG. 9, the controller 413 continuously increases the magnitude of the pressing force in accordance with the number of continuous printing small-size sheets transmitted from the sheet information input mechanism 412. That is, as the number of continuous printing small-size sheets increases from the small number ($N_1$) to the large number ($N_2$) in FIG. 9, the temperature at lateral ends rises. Therefore, in order to prevent the influence of the temperature rise at lateral ends, the controller 413 gradually increases the pressing force of the pressure roller 203, that is, increases a pressing force of the pressure roller 203 in proportion to an increase in the number of the small-size sheets, and makes the end nip width relatively smaller than the center portion nip width. That is, a ratio $N_R$ of the lateral end nip width $N_{L1}$ to the center nip width $NL_2$ ($N_R=N_{L2}/N_{L1}$) decreases from the ratio $N_{R1}$ at the small number of printing $N_1$ to the ratio $N_{R2}$ at the large number of printing $N_2$ ($N_{R1}>N_{R2}$). The controller 413 controls the ratio $N_R$ in the second mode smaller than the one in the first mode.

This control effectively decreases the temperature rise at lateral ends and avoids increase of the waiting time and the fixing failure of the large-size sheet after small-size sheet printing. The increase of the center nip width leads to increase of heat given to a center portion of the large-size sheet, and this enables setting lower fixing temperature. Setting the lower fixing temperature saves energy. Although this effect is based on an inherent countermeasure, in the case of a medicine bag machine or the like, this second mode is important and useful.

Instead of counting the number of continuous printing small-size sheets, the controller 413 may control the magnitude of the pressing force based on a temperature detected by a temperature sensor disposed at the lateral end portion of the fixing sleeve 201 at which the temperature rise at the lateral ends occurs. However, since additional cost is required for installing the temperature sensor, it is preferable to examine a relation between the number of continuous printing small-size sheets and the temperature at lateral end beforehand by experiment or the like, determine a predetermined number of printing small-size sheets in which the pressing force is increased in the second mode based on the experiment, and control the pressing force according to the number of continuous printing small-size sheets. This is advantageous in reducing the cost of the fixing device. Since a deviation of a surface pressure/a nip width affects sheet conveyance, it is desirable not to change the relation between the surface pressure/the nip width between the center and the lateral end more than necessary.

The present disclosure is not limited to the details of the embodiments described above, and various modifications and improvements are possible.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A fixing device comprising:

a fixing sleeve;

a pair of holders oppositely disposed in an axial direction of the fixing sleeve to rotatably support both ends of the fixing sleeve in the axial direction;

a heater to heat the fixing sleeve;

a nip formation pad disposed between the pair of holders and having a regular crown-shaped surface abutted against an inner circumferential surface of the fixing sleeve;

a pressing member disposed opposite the fixing sleeve to form a nip with the nip formation pad in a state of abutting against the fixing sleeve, the pressing member to rotate in the state of abutting against the fixing sleeve to rotate the fixing sleeve, the nip having a width in a direction perpendicular to the axial direction of the fixing sleeve;

a pressing mechanism to press the pressing member toward the nip formation pad; and a controller to control the pressing mechanism, the controller controlling the pressing mechanism in a first mode in which the pressing mechanism presses the pressing member toward the nip formation pad with a first pressing force to equalize the width of the nip in a longitudinal direction of the abutted surface, and in a second mode in which the pressing mechanism presses the pressing member toward the nip formation pad with a second pressing force greater than the first pressing force so that the width of the nip is smaller at both ends of the nip in the longitudinal direction than at a center of the nip in the longitudinal direction.

2. The fixing device according to claim 1, wherein the nip formation pad has a greater rigidity at a longitudinal center of the nip formation pad than at longitudinal ends of the nip formation pad such that the abutted surface of the nip formation pad has a regular crown shape in which the longitudinal center projects toward the pressing member in a state in which the pressing member abuts against the fixing sleeve with the second pressing force in the second mode.

3. The fixing device according to claim 1, further comprising a stay to support a back side of the nip formation pad, wherein the stay has a greater rigidity at a longitudinal center of the stay than at longitudinal ends of the stay so that the abutted surface of the nip formation pad has a regular crown shape in which the longitudinal center of the nip formation pad projects toward the pressing member in a state in which the pressing member abuts against the fixing sleeve with the second pressing force in the second mode.

4. The fixing device according to claim 1, wherein the controller executes the second mode when a large-size recording medium passes through the fixing device after a predetermined number or more small-size recording media continuously pass through the fixing device;

wherein the small-size recording medium has a smaller width in the axial direction of the fixing sleeve than the longitudinal length of the heater, and the large-size recording medium has a larger width in the axial direction of the fixing sleeve than the width of the small-size recording medium.

5. The fixing device according to claim 1, wherein the controller executes the second mode when a large-size recording medium passes through the fixing device after a predetermined number or more small-size recording media continuously pass through the fixing device, and the controller increases a pressing force of the pressing mechanism in proportion to an increase in number of the small-size recording media that continuously pass through the fixing device;

wherein the small-size recording medium has a smaller width in the axial direction of the fixing sleeve than the longitudinal length of the heater, and the large-size recording medium has a larger width in the axial direction of the fixing sleeve than the width of the small-size recording medium.

6. An image forming apparatus comprising the fixing device according to claim 1.

* * * * *